US011172761B2

(12) United States Patent
Van Zile, Jr.

(10) Patent No.: US 11,172,761 B2
(45) Date of Patent: Nov. 16, 2021

(54) VEHICLE DOOR STORAGE UNIT

(71) Applicant: Bruce John Van Zile, Jr., Fort Walton Beach, FL (US)

(72) Inventor: Bruce John Van Zile, Jr., Fort Walton Beach, FL (US)

( * ) Notice: Subject to any disclaimer, the term of this patent is extended or adjusted under 35 U.S.C. 154(b) by 0 days.

(21) Appl. No.: 17/195,423

(22) Filed: Mar. 8, 2021

(65) Prior Publication Data

US 2021/0274932 A1 Sep. 9, 2021

Related U.S. Application Data

(60) Provisional application No. 62/987,225, filed on Mar. 9, 2020.

(51) Int. Cl.

| | |
|---|---|
| ***B62B 3/02*** | (2006.01) |
| ***A47B 81/00*** | (2006.01) |
| ***A47B 43/00*** | (2006.01) |

(52) U.S. Cl.

CPC ..... *A47B 81/00* (2013.01); *A47B 43/00* (2013.01)

(58) Field of Classification Search

CPC ..... B62L 33/02; B62L 33/008; B62L 33/022; B62L 33/108; A47B 81/00; A47B 43/00

See application file for complete search history.

(56) References Cited

U.S. PATENT DOCUMENTS

| | | | | |
|---|---|---|---|---|
| 4,637,626 A * | 1/1987 | Foss | A45C 13/385 | 16/113.1 |
| 5,040,809 A * | 8/1991 | Yang | B62B 3/02 | 280/42 |
| 7,237,758 B2 * | 7/2007 | Nikolic | B25H 1/0007 | 248/127 |
| 7,377,502 B2 * | 5/2008 | Nikolic | B25H 1/0007 | 269/17 |
| 9,381,128 B2 * | 7/2016 | Rozewicz | A61G 13/009 | |
| 9,623,889 B2 * | 4/2017 | Wallace-Riley | B62B 3/004 | |
| 9,903,527 B1 * | 2/2018 | Wiborg | F16M 11/20 | |
| 10,376,045 B1 * | 8/2019 | Poudrier | B62B 3/002 | |
| 10,384,499 B2 | 8/2019 | Schocke et al. | | |

(Continued)

OTHER PUBLICATIONS

Hooke Road® Rock Crawler Door Storage(07-20 Jeep Wrangler JK/JKU JL/JLU 4 Door), https://www.ubox-offroad.com/products/4-door-rock-crawler-door-storage-door-holder-sliding-rack-for-jeep-wrangler-jk-jl-bxg060.

(Continued)

*Primary Examiner* — Kimberley S Wright

(57) ABSTRACT

A vehicle door storage unit has a door storage frame, at least one lower door support member rotatably connected to a lower end of the door storage frame, and at least one hinge mount adjustably mounted along the door storage frame between the lower end and an upper end of the door storage frame. The hinge mounts may be adjustably mounted to the door storage frame through a tightening mechanism. Each hinge mount has one or more pin receptacles configured to receive a hinge pin of a vehicle door that has been uninstalled from a vehicle. The hinge mounts secure the vehicle door to the door storage frame, while the lower door support members support the mounted doors from below. The lower door support members can rotate between a deployed position for storing a vehicle door on the present invention and a stored position, folded against the door storage frame.

9 Claims, 4 Drawing Sheets

(56) References Cited

U.S. PATENT DOCUMENTS

| | | | | |
|---|---|---|---|---|
| 10,471,980 | B1 * | 11/2019 | Jordan | B62B 3/16 |
| 10,981,588 | B1 * | 4/2021 | Poudrier | B62B 3/108 |
| 2005/0011135 | A1 * | 1/2005 | Hallberg | E04H 3/28 52/7 |
| 2006/0086317 | A1 | 4/2006 | Fiedler | |
| 2006/0113435 | A1 * | 6/2006 | Nikolic | B25H 1/0007 248/122.1 |
| 2014/0217045 | A1 * | 8/2014 | Nesin | A47F 7/00 211/85.8 |
| 2015/0118006 | A1 * | 4/2015 | Wallace-Riley | B62B 3/005 414/800 |
| 2019/0331291 | A1 * | 10/2019 | Poudrier | B25H 1/0007 |

OTHER PUBLICATIONS

Quadratec Deluxe Storage Cart for Half or Full Steel Doors, https://www.quadratec.com/p/quadratec/deluxe-storage-cart-steel-doors.

Jeep Wrangler TJ or JK 2-door Storage Cart/ Door Holder, https://www.ebay.com/itm/Jeep-Wrangler-TJ-or-JK-2-door-Storage-Cart-Door-Holder/201657323153.

* cited by examiner

VEHICLE DOOR STORAGE UNIT

The current application claims a priority to the U.S. Provisional Patent application Ser. No. 62/987,225 filed on Mar. 9, 2020.

FIELD OF THE INVENTION

The present invention generally relates to a storage device. More specifically, the present invention relates to a storage assembly for detachable vehicle doors.

BACKGROUND OF THE INVENTION

A portable storage device for vehicle doors is in demand. Some vehicles currently on the market feature removable parts—the Jeep, for example, which allows users to remove or add parts as they wish, so that a user can easily take the doors off the vehicle. However, finding a place to store doors after removing them from the vehicle can be difficult: Leaning them against a wall or laying them on the ground may damage or dirty them.

To solve this storage problem, door-stands and wall hangers have been developed, but these are designed for use in a single location and are not easily portable.

Some storage devices are designed to attach to the back of the vehicle, and others to a trailer hitch, and thus often block access to rear storage when installed. In addition, most currently available vehicle door storage devices are bulky and difficult to use and handle.

Accordingly, there is a need to develop a device that solves these problems. The present invention is intended to address problems associated with and/or otherwise improve on conventional devices through an innovative door storage device that is designed to provide a convenient means of portability while incorporating other problem-solving features.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

Figure 1:
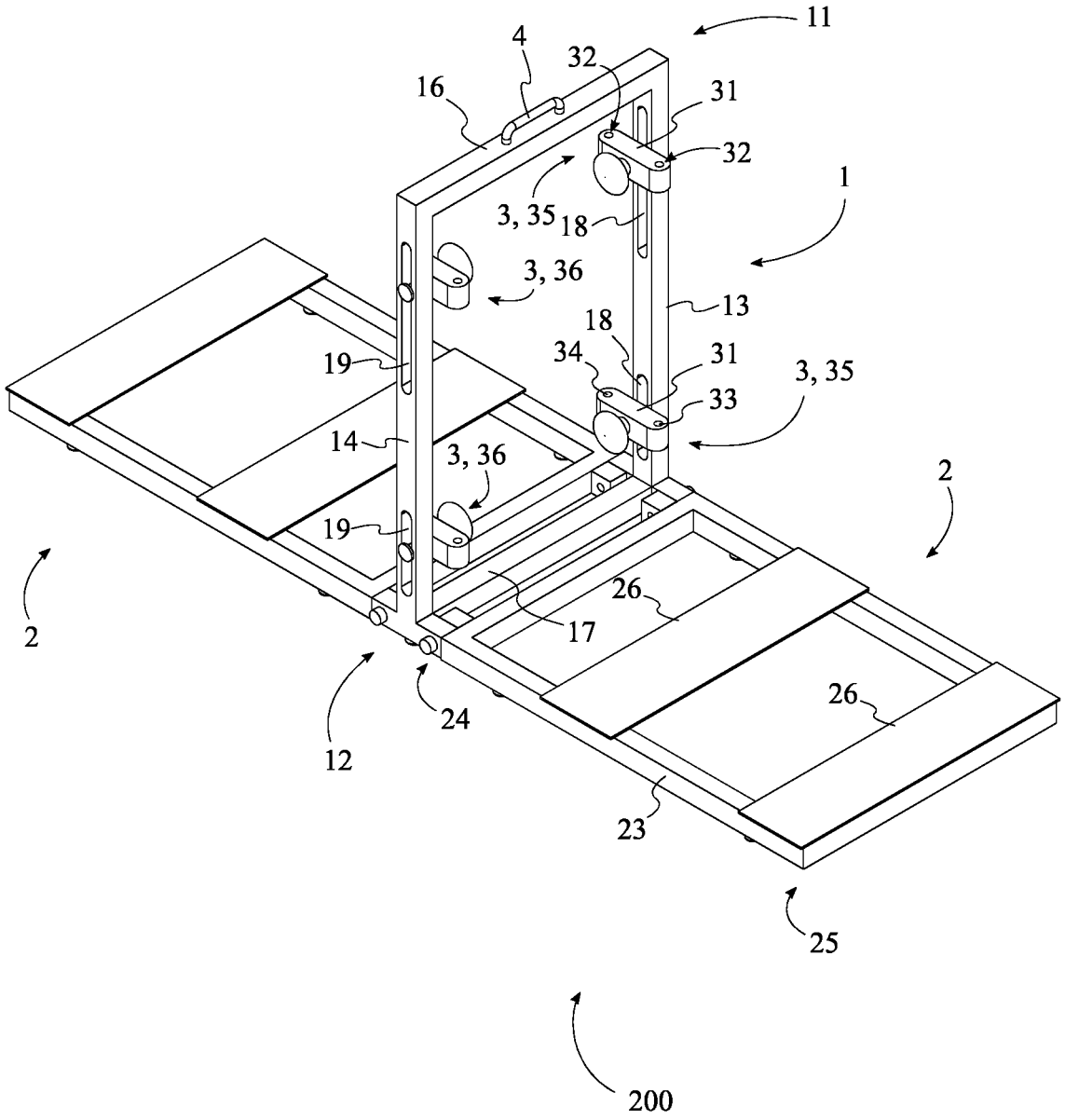
FIG. 1 is a perspective view of the present invention with two lower door support members in the deployed position according to an embodiment of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention provides a storage unit for detachable vehicle doors. In general, referring to FIGS. 1-2, the preferred embodiment of the present invention comprises a door storage frame 1, at least one lower door support member 2, and at least one door hinge mount 3. The door storage frame 1 is the main structure of the present invention which serves to receive and support one or more vehicle doors that have been detached from their host vehicle. The door storage frame 1 is designed to receive the hinge pins of a vehicle door in order to secure the vehicle door to the door storage frame 1. As this mounting means is lateral and terminal in nature with respect to such a vehicle door, the vehicle door's center of gravity is separated from that of the door storage frame by a moment arm, and thus the vehicle door's weight applies a moment force to the door storage frame. Therefore, it is desirable to stabilize the door support frame and support the vehicle door from below. The at least one lower door support member 2 is included to provide this functionality of lower support for a vehicle door stored on the door storage frame 1 and stabilization of the present invention as a whole. The at least one door hinge mount 3 is the component of the present invention that specifically receives a hinge pin of a vehicle door and serves to mount the vehicle door to the door storage frame 1.

More particularly, in the preferred embodiment of the present invention, the door storage frame 1 extends vertically between an upper end 11 and a lower end 12. Each of the at least one lower door support member 2 is rotatably connected to the door storage frame 1 adjacent to the lower end 12, wherein each of the at least one lower door support member 2 is configured to rotate between a stored configuration 100 and a deployed configuration 200. In the preferred embodiment, each of the at least one lower door support member 2 is oriented perpendicular to the door storage frame 1 in the deployed configuration 200 and parallel to the door storage frame 1, or more generally, raised from the deployed configuration 200 toward the door storage frame 1, in the stored configuration 100. Generally, each lower door support member may be understood to form a capital "L" shape with the door storage frame 1 in the deployed configuration 200, with the lower door support member hinging at the bottom of the "L", which corresponds to the joint between the door support member and the door storage frame 1. However, this arrangement should not necessarily be considered to be limiting, and other similarly suitable arrangements may be utilized in various embodiments without departing from the intended spirit and scope of the present invention.

In the preferred embodiment of the present invention, each of the at least one lower door support member 2 comprises a support frame 23, a proximal end 24, a distal end 25, and a plurality of cross members 26. The support frame 23 extends between the proximal end 24 and the distal end 25, with the proximal end 24 of each of the at least one lower door support member 2 being rotatably connected to the lower end 12 of the door storage frame 1. Each of the plurality of cross members 26 is connected adjacent to the support frame 23; more particularly, each of the plurality of cross members 26 is connected atop the support frame 23 in the preferred embodiment. Further, each of the plurality of cross members 26 is oriented laterally and parallel to each other, and the plurality of cross members 26 is distributed between the proximal end 24 and the distal end 25. The plurality of cross members 26 serves to provide lower support to a vehicle door supported by the hinge mounts 3 on the door storage frame 1. In some embodiments, the plurality of cross members 26 may be replaced with a flat top surface for one or more of the lower door support members, or any other similarly suitable configuration.

Figure 2:
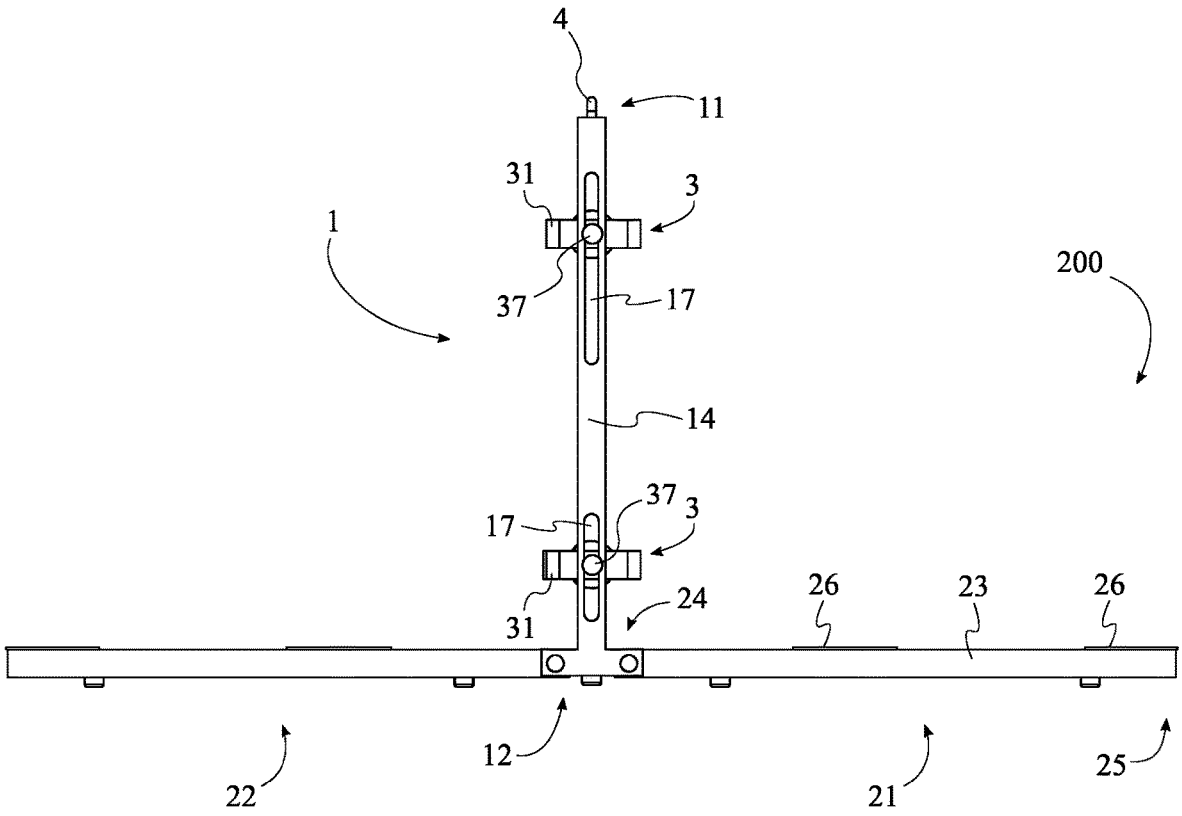
FIG. 2 is a side view of FIG. 1.

In the preferred embodiment of the present invention, the at least one lower door support member 2 comprises a first lower door support member 21 and a second lower door support member 22, as shown in FIG. 2. The first lower door support member 21 and the second lower door support member 22 are positioned longitudinally opposite each other relative to the door storage frame 1, such that when both the first lower door support member 21 and the second lower door support member 22 are in the deployed configuration 200, the present invention resembles an inverted "T" shape, with the first lower door support member 21 and the second lower door support member 22 being symmetric about the door storage frame 1. The first lower door support member 21 is terminally and rotatably connected to the lower end 12 of the door storage frame 1, while the second lower door support member 22, similarly, is terminally and rotatably connected to the lower end 12 of the door storage frame 1 opposite the first lower door support member 21 along the door storage frame 1. This arrangement allows two vehicle doors to be stored using the present invention. Alternatively, in some embodiments, only a single lower door support member 2 may be comprised.

In the preferred embodiment of the present invention, each of the at least one door hinge mount 3 is adjustably mounted along the door storage frame 1 between the upper end 11 and the lower end 12. The particular vertical location of any given hinge mount 3 between the upper end 11 and the lower end 12 may be selectably adjusted by the user in the preferred embodiment through means discussed later herein, in order to accommodate variations in vehicle doors or other conditions. Each of the at least one door hinge mount 3 comprises a mount body 31 and at least one hinge pin receptacle 32. Each of the at least one hinge pin receptacle 32 traverses through the mount body 31, or into the mount body 31 in some embodiments, and each of the at least one hinge pin receptacle 32 is sized to receive a hinge pin of a vehicle door.

In the preferred embodiment, the door storage frame 1 comprises a first lateral member 13, a second lateral member 14, a lower member 15, and an upper member 16, as shown in FIG. 1. The first lateral member 13 and the second lateral member 14 are terminally and perpendicularly connected to the lower member 15, wherein the lower member 15 is positioned at the lower end 12. The first lateral member 13 and the second lateral member 14 are positioned laterally opposite each other along the lower member 15. The upper member 16 is terminally connected between the first lateral member 13 and the second lateral member 14 opposite the lower member 15 along the first lateral member 13 and the second lateral member 14, wherein the upper member 16 is positioned at the upper end 11. Stated alternatively, the first lateral member 13, the second lateral member 14, the lower member 15, and the upper member 16 generally form a rectangular shape for the door storage frame 1. However, it should be noted that although the aforementioned members are stated to be comprised in the preferred embodiment, it is contemplated that any suitable complement of components and geometric arrangement thereof may be employed which suitably accomplishes the desired function of the door storage frame 1 according to the spirit and scope of the present invention as disclosed herein.

Figure 4:
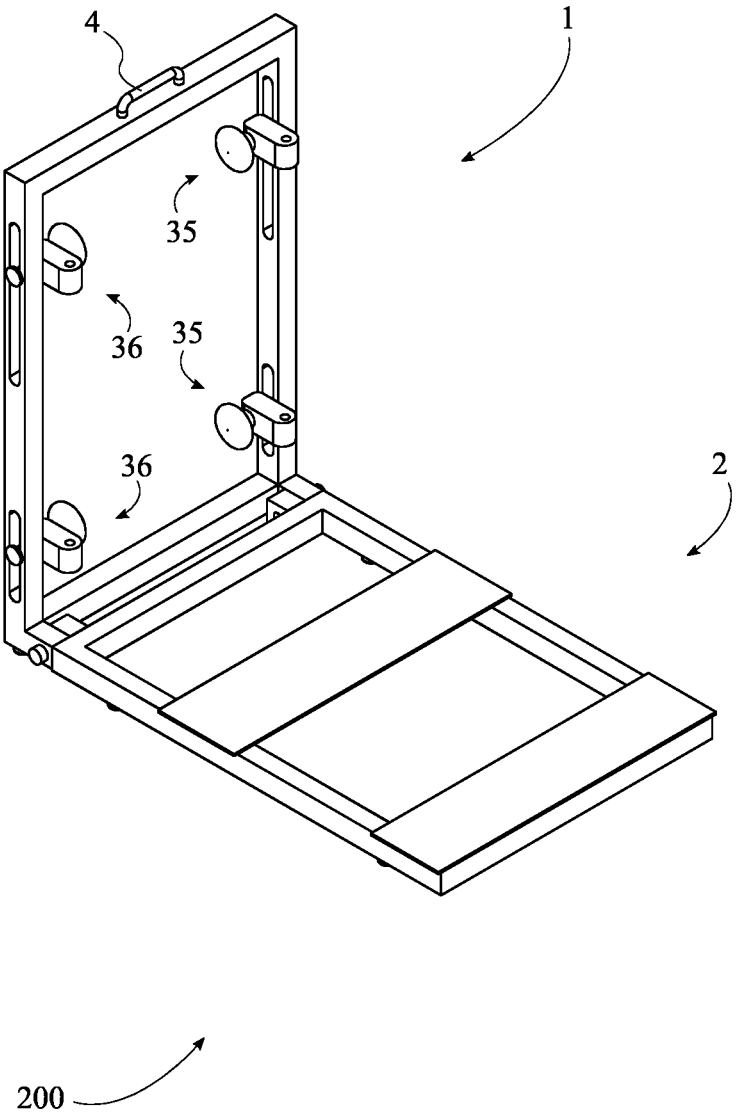
FIG. 4 is a perspective view of the present invention with a single lower door support member in the deployed position according to an embodiment of the present invention.

In the preferred embodiment, the at least one door hinge mount 3 comprises a first pair of door hinge mounts 35 and a second pair of door hinge mounts 36, as shown in FIGS. 1 and 4. The first pair of door hinge mounts 35 is adjustably mounted along the first lateral member 13 between the upper member 16 and the lower member 15 of the door storage frame 1. The second pair of door hinge mounts 36 is adjustably mounted along the second lateral member 14 between the upper member 16 and the lower member 15.

Generally, vehicle doors, particularly Jeep doors, are attached to their respective vehicle through a pair of hinge pins that are vertically separated from each other and axially aligned with each other. Thus, the at least one door hinge mount 3, and more particularly the first pair of door hinge mounts 35 and the second pair of door hinge mounts 36, are configured to accommodate such an arrangement.

It is further contemplated that the geometrical arrangement of door hinge pins may vary across vehicle makes and models, and the present invention may vary accordingly in different embodiments. For example, given an exemplary vehicle door whose hinge pins are axially offset from each other, the door hinge mounts may vary in geometry to match, with an exemplary upper door hinge mount having a different distance from the door storage frame 1 to its hinge pin receptacle than an exemplary lower door hinge mount, thereby offsetting the axes of said hinge pin receptacles to match the axial offset of the exemplary vehicle door hinge pins.

The specific means of adjustability of the door hinge mounts 3 along the door storage frame 1 may vary in different embodiments, so long as the door hinge mounts 3 are able to be manually positioned by the user to a desirable vertical location on the door storage frame 1. In the preferred embodiment, however, the door storage frame 1 further comprises at least one mounting slot 17, with each of the at least one mounting traversing through the door storage frame 1, as shown in FIG. 2. Alternatively, in some embodiments, each of the at least one mounting slot 17 may traverse a specified distance into the door storage frame 1, as opposed to penetrating completely through the door storage frame 1, which may not be a necessary condition in all embodiments.

More particularly, in the preferred embodiment, the at least one mounting slot 17 comprises a first pair of mounting slots 18 and a second pair of mounting slots 19. The first pair of mounting slots 18 laterally traverses through the first lateral member 13 of the door storage frame 1, while the second pair of mounting slots 19 laterally traverses through the second lateral member 14. The first pair of mounting slots 18 and the second pair of mounting slots 19 is distributed vertically along the door storage frame 1, with each pair of slots comprising an upper slot and a lower slot. Each of the first pair of door hinge mounts 35 is adjustably mounted along one of the first pair of mounting slots 18, and each of the second pair of door hinge mounts 36 is adjustably mounted along one of the second pair of mounting slots 19. As previously noted, instead of the mounting slots as previously described, any other suitable means of vertical adjustability for the door hinge mounts may be employed as desired. In some embodiments, for example, instead of mounting slots, a plurality of holes may be utilized in order to index the door hinge mounts to specific vertical locations on the door storage frame 1.

Figure 3:
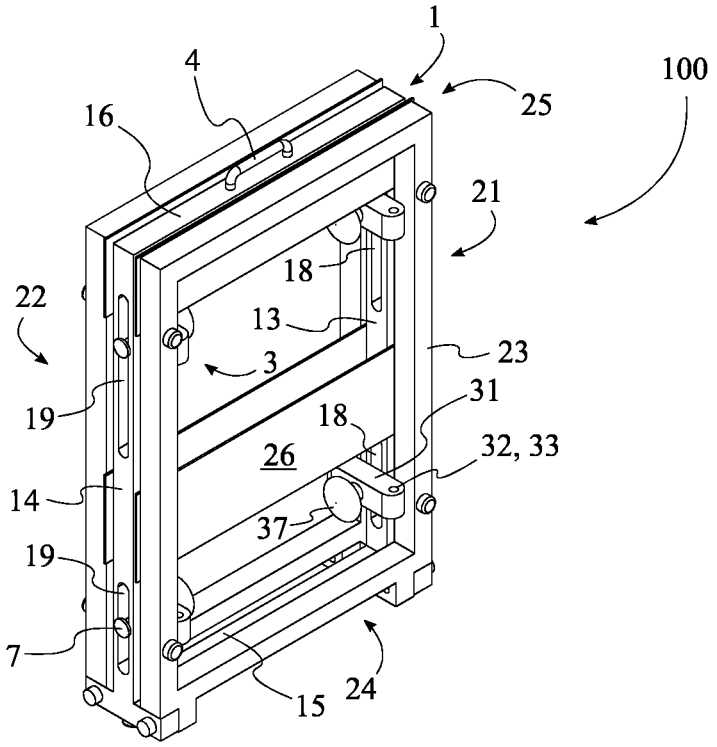
FIG. 3 is a perspective view of the present invention with two lower door support members in the stored position according to an embodiment of the present invention.

Preferably, each of the at least one door hinge mount 3 comprises a first hinge pin receptacle 33 and a second hinge pin receptacle 34 as the at least one hinge pin receptacle 32, as shown in FIGS. 1 and 3. The first hinge pin receptacle 33 and the second hinge pin receptacle 34 are oriented parallel to each other and positioned opposite each other along the mount body 31, such that the mount body 31 is preferably positioned longitudinally symmetric with the door storage frame 1, wherein a first lateral member 13 and a second lateral member 14 of the door storage frame 1 are positioned longitudinally equidistant between the first hinge pin receptacle 33 and the second hinge pin receptacle 34. It should be noted that this arrangement corresponds to embodiments where the at least one lower door support member 2 comprises the first lower door support member 21 and the second lower door support member 22 as previously described. In embodiments with a single lower door support member 2, each door hinge mount 3 may correspondingly only comprise a single hinge pin receptacle 32 positioned on the side of the single lower door support member.

Further, in the preferred embodiment, each of the at least one door hinge mount 3 further comprises a tightening mechanism 37, and each of the at least one door hinge mount 3 is adjustably mounted to the door storage frame 1 through the tightening mechanism 37. Alternatively, in some embodiments, each of the at least one door hinge mount 3 may be affixed in place on the door storage frame 1 through alternate means, such as, but not limited to, an indexing pin and series of pin holes arrangement, or another type of locking mechanism or other suitable means.

In the preferred embodiment, the tightening mechanism 37 comprises a tightening handle and a bolt. The bolt traverses through the mount body 31 of its respective door hinge mount, and further traverses through (or into) one of the at least one mounting slot 17, within which the bolt is held captive but free to move along. The tightening handle is threadedly engaged with the bolt, and positioned adjacent to the mount body 31 opposite the door storage frame 1, such that turning the tightening handle displaced the tightening handle toward the door storage frame 1 in order to affix the mount body 31 in place along the mounting slot through friction.

In the preferred embodiment of the present invention, a carry handle 4 is further comprised. The carry handle 4 is preferably connected atop the upper member 16 of the door storage frame 1, opposite the first lateral member 13 and the second lateral member 14 of the door storage frame 1; alternatively stated, the upper member 16 is positioned vertically between the lateral members and the carry handle 4. Further, the present invention may also comprise a plurality of rubber feet, which are connected to a bottom side of each of the at least one lower door support as well as the door storage frame 1. The plurality of rubber feet serve to stabilize the present invention as well as protecting the present invention and any surface it may be placed onto from damage due to any potential interactions between them, such as dropping, scraping, etc.

Although the invention has been explained in relation to its preferred embodiment, it is to be understood that many other possible modifications and variations can be made without departing from the spirit and scope of the invention as hereinafter claimed.

What is claimed is:

1. A vehicle door storage unit comprising:

a door storage frame;

at least one lower door support member;

at least one door hinge mount;

the door storage frame extending vertically between an upper end and a lower end;

each of the at least one lower door support member being rotatably connected to the door storage frame adjacent to the lower end, wherein each of the at least one lower door support member is configured to rotate between a stored configuration and a deployed configuration;

each of the at least one door hinge mount being adjustably mounted along the door storage frame between the upper end and the lower end;

each of the at least one door hinge mount comprising a mount body and at least one hinge pin receptacle;

each of the at least one hinge pin receptacle traversing into the mount body, wherein each of the at least one hinge pin receptacle is sized to receive a hinge pin of a vehicle door;

the door storage frame further comprising at least one mounting slot;

the at least one mounting slot traversing through the door storage frame;

each of the at least one door hinge mount being adjustably mounted along one of the at least one mounting slot;

the door storage frame comprising a first lateral member, a second lateral member, a lower member, and an upper member;

the at least one door hinge mount comprising a first pair of door hinge mounts and a second pair of door hinge mounts;

the at least one mounting slot comprising a first pair of mounting slots and a second pair of mounting slots;

the first pair of mounting slots laterally traversing through the first lateral member;

the second pair of mounting slots laterally traversing through the second lateral member;

each of the first pair of door hinge mounts being adjustably mounted along one of the first pair of mounting slots; and each of the second pair of door hinge mounts being adjustably mounted along one of the second pair of mounting slots.

2. The vehicle door storage unit as claimed in claim 1, wherein each of the at least one lower door support member is oriented perpendicular to the door storage frame in the deployed configuration and parallel to the door storage frame in the stored configuration.

3. The vehicle door storage unit as claimed in claim 1 comprising:

the first lateral member and the second lateral member being terminally and perpendicularly connected to the lower member, wherein the lower member is positioned at the lower end;

the first lateral member and the second lateral member being positioned laterally opposite each other along the lower member; and the upper member being terminally connected between the first lateral member and the second lateral member opposite the lower member along the first lateral member and the second lateral member, wherein the upper member is positioned at the upper end.

4. The vehicle door storage unit as claimed in claim 1 comprising:

the first pair of door hinge mounts being adjustably mounted along the first lateral member between the upper member and the lower member; and the second pair of door hinge mounts being adjustably mounted along the second lateral member between the upper member and the lower member.

5. The vehicle door storage unit as claimed in claim 1 comprising:

each of the at least one door hinge mount comprising a first hinge pin receptacle and a second hinge pin receptacle as the at least one hinge pin receptacle;

the first hinge pin receptacle and the second hinge pin receptacle being oriented parallel to each other and positioned opposite each other along the mount body; and the mount body being positioned longitudinally symmetric with the door storage frame, wherein a first lateral member and a second lateral member of the door storage frame are positioned longitudinally equidistant between the first hinge pin receptacle and the second hinge pin receptacle.

6. The vehicle door storage unit as claimed in claim 1 comprising:

each of the at least one door hinge mount further comprising a tightening mechanism; and each of the at least one door hinge mount being adjustably mounted to the door storage frame through the tightening mechanism.

7. The vehicle door storage unit as claimed in claim 1 comprising:

the at least one lower door support member comprising a first lower door support member and a second lower door support member;

the first lower door support member being terminally and rotatably connected to the lower end of the door storage frame; and the second lower door support member being terminally and rotatably connected to the lower end of the door storage frame opposite the first lower door support member along the door storage frame.

8. The vehicle door storage unit as claimed in claim 1 comprising:

each of the at least one lower door support member comprising a support frame, a proximal end, a distal end, and a plurality of cross members;

the support frame extending between the proximal end and the distal end;

the proximal end of each of the at least one lower door support member being rotatably connected to the lower end of the door storage frame;

each of the plurality of cross members being connected adjacent to the support frame;

each of the plurality of cross members being oriented laterally and parallel to each other; and the plurality of cross members being distributed between the proximal end and the distal end.

9. The vehicle door storage unit as claimed in claim 1 comprising:

a carry handle; and the carry handle being connected atop an upper member of the door storage frame, opposite a first lateral member and a second lateral member of the door storage frame.

* * * * *